US005297870A

United States Patent [19]

Weldon

[11] Patent Number: 5,297,870

[45] Date of Patent: Mar. 29, 1994

[54] BAG WITH OVERLAPPING CLOSURE FLAPS

[76] Inventor: Henry H. Weldon, 17207 N. 49th Ave., Glendale, Ariz. 85308

[21] Appl. No.: 923,609

[22] Filed: Aug. 3, 1992

[51] Int. Cl.[5] ..... B65D 33/16

[52] U.S. Cl. ..... 383/59; 383/61; 383/97; 383/99

[58] Field of Search ..... 383/59, 61, 97, 98, 383/99, 48, 53, 66, 907; 190/113, 114

[56] References Cited

U.S. PATENT DOCUMENTS

| | | | |
|---|---|---|---|
| 2,062,001 | 11/1936 | Grenier | 383/59 |
| 2,337,860 | 12/1943 | Zeitenberg | 383/99 X |
| 2,601,465 | 6/1952 | Tatom | 383/59 X |
| 3,073,367 | 1/1963 | Samara | 383/97 |
| 3,102,570 | 9/1963 | Fairchilds | 383/59 |
| 3,674,073 | 7/1972 | Hendon | 383/98 X |
| 3,726,329 | 4/1973 | Dean | 383/97 X |
| 3,955,728 | 5/1976 | Jackson et al. | 383/907 X |
| 4,112,556 | 9/1978 | Flaum et al. | 383/97 X |
| 4,773,515 | 9/1988 | Kotkins, Jr. | 383/97 X |
| 5,149,203 | 9/1992 | Sacks | 383/111 |

*Primary Examiner*—Allan N. Shoap
*Assistant Examiner*—Christopher McDonald
*Attorney, Agent, or Firm*—Tod R. Nissle

[57] ABSTRACT

A bag for storing articles includes a pair of overlapping closure flaps. One of the flaps is water resistant. The other flap is a mesh flap which permits air to circulate into and out of the bag. One flap or the other can, at the user's discretion, be used to close the bag.

6 Claims, 2 Drawing Sheets

BAG WITH OVERLAPPING CLOSURE FLAPS

This invention relates to luggage.

More particularly, the invention relates to a bag which, after articles are placed in the bag for storage and transport, can be sealed to prevent water from entering the bag or can be closed to permeate the ready circulation of air into and out of the bag.

In a further respect, the invention relates to a bag which can utilize a single zipper to attach either of two separate tongues to a bag to seal the bag closed.

A wide variety of baggage is well known in the art. See, for example, U.S. Pat. Nos. 4,842,032 to Mastronardo, 4,805,749 to Gerch, 4,790,051 to Knight, 4,463,789 to Leiserson, and 3,998,304 to Edgerton, Jr. et al. Such prior art baggage well serves the goal of providing easy to use, sturdy, portable luggage. It would, however, be highly desirable to provide a bag which would give a user the alternative of either closing the bag to make the bag water resistant or of closing the bag so as to, while preventing articles in the bag from falling out, enable air to readily circulate into and out of the bag. Conventional luggage does not provide such an alternative.

Therefore, it is a principal object of the invention to provide improved luggage.

Another object of the invention is to provide luggage which, after articles are placed in the bag, can be sealed to impede the penetration of the bag by water and air and can, in the alternative, be sealed to enable air to readily circulate into and out of the bag.

These and other, further and more specific objects and advantages of the invention will be apparent to those skilled in the art from the following detailed description thereof, taken in conjunction with the drawings, in which.

Briefly, in accordance with my invention, I provide a bag including a bottom; a top with an opening formed therethrough, the opening including first and second spaced apart opposing edges; a pair of opposed spaced apart ends extending downwardly from the top and upwardly from the bottom; a pair of opposed spaced apart sides each extending upwardly from the bottom, downwardly from the top, and laterally from the ends; a first tongue having a proximate end attached adjacent the first edge of the opening and having a free distal end extending outwardly from the first edge; a second tongue having a proximate end attached adjacent the second edge of the opening and having a free distal end extending outwardly from the second edge, the first and second tongues each being sized to cover the opening; attachment means for detachably securing the distal end of the first tongue to the bag to cover the opening and the second tongue when the free distal end of the second tongue is inserted in the bag, and detachably securing the distal end of the second tongue to the bag to cover the opening and the first tongue when the free distal end of the first tongue is inserted in the bag.

Figure 1:
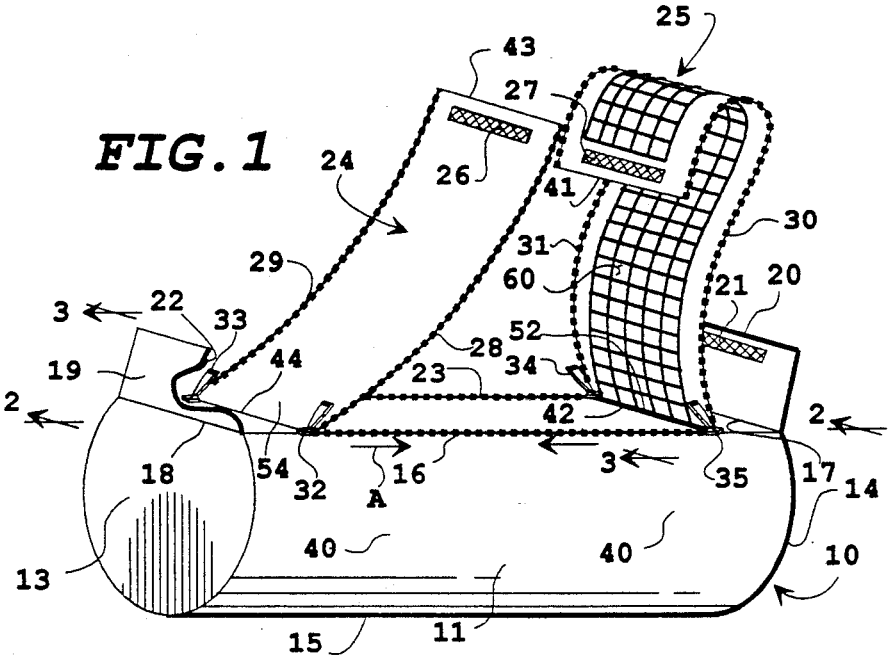
FIG. 1 is a perspective view illustrating a bag constructed in accordance with the principles of the invention.
Figure 2:
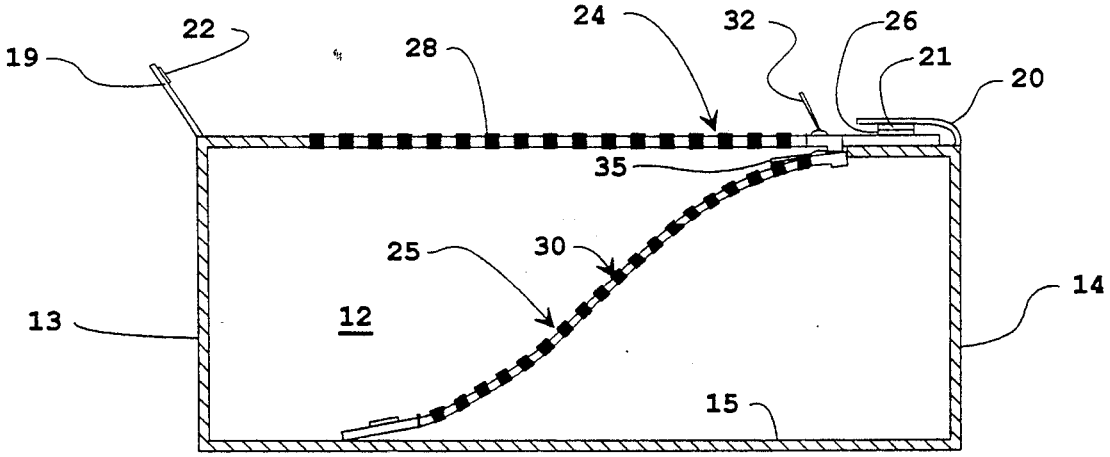
FIG. 2 is a partial section view of the bag of FIG. 1 taken along section line 2—2 and illustrating the mode of operation thereof; and, FIG. 3 is a partial section view of the bag of FIG. 1 taken along section line 3—3 thereof and illustrating an alternative zipper construction utilized in the bag.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 2 illustrate a piece of luggage constructed in accordance with the principles of the invention and generally identified by reference character 10. Luggage 10 includes ends 13 and 14, bottom 15, sides 11 and 12, and top 14. Opposed, spaced apart sides 11 and 12 extend upwardly from bottom 15. Opposed, spaced apart ends 13 and 14 extend upwardly from bottom 15. Sides 11 and 12 and ends 13 and 14 terminate at the top 14 of luggage 10. An aperture is formed through top 14. While the aperture in FIG. 1 can take on any desired shape and dimension, the aperture of FIG. 1 is rectangular in shape. The aperture could, for example, be circular or elliptical in shape. The peripheral edge of the rectangular aperture includes opposed spaced apart generally linear ends or edges 42 and 44 and opposed spaced apart generally parallel edges 16 and 23 each comprised of one of the two interlocking halves of a zipper track. Flap 19 is attached to luggage 10 adjacent edge 18. Velcro patch 22 is attached to flap 19. Flap 20 is attached to luggage 10 adjacent edge 17. Velcro patch 21 is attached to flap 20.

The proximate end of flap or tongue 25 is attached to luggage 10 adjacent edge 42. Velcro patch 27 is attached to flap 25. The distal end of flap 25 includes edges 30 and 31 which each consist of one of the interlocking halves of an elongate zipper track, where a zipper track includes two elongate generally parallel opposed interlocking halves. Each zipper track half is comprised of a row of teeth. Each zipper track half ordinarily is stitched or mounted in the opposing edges of an opening in a pair of pants, a purse, a bag, etc. so that the opening can be opened and closed with a sliding tab which moves back and forth along the zipper track. As is well known, the halves of the zipper track interlock when the zipper track is closed with a sliding tab. The sliding tab functions to force the teeth in each opposing zipper track half into interlocking engagement. The halves of the zipper track are unlocked and are spaced apart when the zipper track is opened with a sliding tab. Interlocking closure is achieved between the zipper track halves 23 and 31 when sliding tab 34 is pulled from the position shown in FIG. 1 toward end 13. Interlocking closure is achieved between zipper track halves 16 and 30 when sliding tab 35 is pulled from the position shown in FIG. 1 toward end 13. While flap 25 can be fabricated from any desired material, flap 25 presently consists of a mesh which readily permits air to flow through openings 60 in the mesh and into and out of the interior of luggage 10.

The proximate end of flap or tongue 24 is attached to luggage 10 adjacent edge 44. Velcro patch 26 is attached to flap 24. The distal end of flap 24 includes edges 28 and 29 which each consist of one of the elongate interlocking halves of a zipper track. Interlocking closure is achieved between zipper track halves 23 and 29 when sliding tab 33 is pulled from the position shown in FIG. 1 toward end 14. Interlocking closure is achieved between zipper track halves 28 and 16 when sliding tab 32 is pulled from the position shown in FIG. 1 toward end 14. While flap 24 can be fabricated from any desired material, flap 24 presently consists of a water resistant material which prevents water and air from readily flowing through flap 24 and into and out of the interior storage area of luggage 10.

Zipper track halves 31 and 29 are identical in shape and dimension such that a sliding tab can be utilized to interlock each track half 31 and 29 with zipper track half 23. Zipper track halves 28 and 30 are identical in shape and dimension such that a sliding tab can be utilized to interlock each track half 28 and 30 with track half 16.

In use, one of flaps 24 and 25 is selected for positioning in luggage 10 intermediate the bottom 15 and the remaining flap 24 or 25. For example, in FIG. 2 flap 25 is selected for positioning intermediate bottom 15 and flap 24. After flap 25 is inserted in luggage 10 sliding tab 32 is pulled in the direction of arrow A in FIG. 1 to force together zipper track halves 16 and 28 along their entire length, and, sliding tab 33 is pulled in the direction of arrow A in FIG. 1 to force together zipper track halves 23 and 29 along their entire length. Flap 20 is positioned over the distal end of flap 24 such that Velcro pad 21 attaches to Velcro pad 26 (FIG. 2). As illustrated in FIG. 2, when zipper track halves 23 and 29 are forced or "zipped" together and zipper track halves 16 and 28 are zipped together, flap 24 covers the rectangular opening formed in the top 40 of luggage 10. In order to disengage flap 24 from zipper tracks 16 and 23, sliding tabs 32 and 33 are pulled in a direction opposite that of arrow A and away from end 14 toward end 13 to return the sliding tabs 32 and 33 to the position illustrated in FIG. 1. When sliding tabs 32 and 33 are in the position illustrated in FIG. 1, the distal end of flap 24 can be freely moved into and out of the interior of luggage 10.

If, instead of flap 25, flap 24 is selected for positioning in luggage 10 intermediate the bottom 15 and the remaining flap 25, then, after flap 24 is placed inside the bag, sliding tabs 34 and 35 are pulled away from end 14 in a direction of travel toward end 13 to zip track half 31 to track half 23 and to zip track half 30 to track half 16, respectively. Flap 19 is pulled over the distal end of flap 25 to secure Velcro patch 22 to patch 27.

Figure 3:
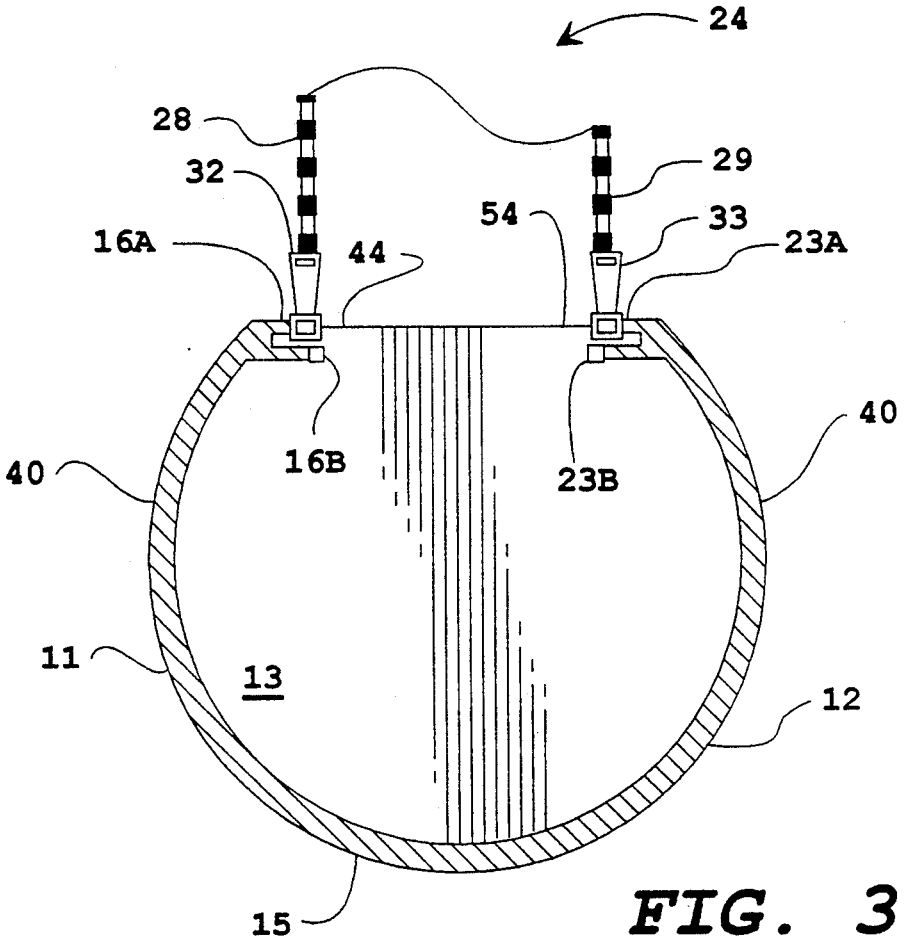

An alternate embodiment of the invention is illustrated in FIG. 3. In FIG. 3, track half 16 is replaced with a pair of spaced apart parallel track halves 16A and 16B. Track half 23 is replaced with a pair of spaced apart parallel track halves 23A and 23B. In use, sliding tab 32 zips track halves 16A and 28 together and apart; and, sliding tab 33 zips track halves 29 and 23A together and apart. Further, sliding tab 34 (not shown in FIG. 3) zips track halves 31 and 23B together and apart; and, sliding tab 35 zips track halves 30 and 16B together and apart. Consequently, in the embodiment of the invention illustrated in FIG. 3, each flap 24 and 25 utilizes zipper track halves which are not utilized by the other flap and which permit the flaps 24 and 25 to each be zippered closed with flap 24 on top of flap 25, or which permit the distal end of flap 24 to be inserted in the interior of luggage 24 and permit track halves 30 and 31 of flap 25 to be interlocked with track halves 16B and 23B to seal the opening formed in the top 40 and to seal flap 24 in the interior of luggage 10 between bottom 15 and flap 25.

In FIG. 1, the proximate end of flap 25 is attached to luggage 10 adjacent edge 42. If desired, the proximate end of flap 25 can be detached from luggage 10; edge 30 of flap 25 can be fixedly attached along edge 16; a length of a zipper track half can be secured along each edge 41 and 52 of flap 25; and, a length of a zipper track half can be attached to luggage 10 adjacent edges 42 and 44. This would permit the zipper track half on edge 41 to be zipped together and interlocked with the zipper track half adjacent edge 44 and would permit the zipper track half along edge 52 to be zipped together and interlocked with the zipper track half adjacent edge 42. Edge 31 can be provided with a strip of Velcro to permit edge 31 to be removably secured to luggage 10 near edge 23. Similarly, in FIG. 1, the proximate end of flap 24 is attached to luggage 10 adjacent edge 44. If desired, the proximate end of flap 24 can be fixedly detached from luggage 10; edge 29 of flap 24 can be attached along edge 23; and, a length of zipper track half can be secured along each edge 43 and 54 of flap 24. This would permit the zipper track half along edge 43 to be zipped together and interlocked with the zipper track half adjacent edge 42 and would permit the zipper track half along edge 44 to be zipped together and interlocked with the zipper track half adjacent edge 54. Edge 28 can be provided with a strip of Velcro to permit edge 28 to be removably secured to luggage 10 near edge 16. In the embodiment of the invention described in the preceding portion of this paragraph, edge 29 of flap 24 is at the proximate end attached to luggage 10, and edges 43, 28, 54 of flap 24 circumscribe the peripheral edge of the distal free end of flap 24. Similarly, edge 30 of flap 25 is at the proximate end of flap 25 and edges 41, 31, 52 of flap 25 circumscribe the peripheral edge of the distal free end of flap 24. In FIG. 1, edge 52 is at the proximate end of flap 25 and edges 30, 41, 31 circumscribe the distal free end of flap 25. Edge 54 is at the proximate end of flap 24 and edges 28, 43, 29 circumscribe the distal free end of flap 24.

Luggage 10 ordinarily is provided with a carrying strap or handle. Luggage 10 can be adapted to storing clothing or any other desired articles in the interior of luggage 10.

Having described the presently preferred embodiment of my invention in such terms as to enable those skilled in the art to understand and practice it,

I claim:

1. A bag including (a) a bottom;

(b) a top with an opening formed therethrough, said opening including first and second spaced apart opposing end edges (42,44) and first and second spaced apart opposing side edges (16,23) each extending between said opposing end edges;

(c) a pair of opposed spaced apart ends extending downwardly from said top and upwardly from said bottom;

(d) a pair of opposed spaced apart sides each extending upwardly from said bottom, downwardly from said top, and laterally from said ends;

(e) a first tongue (25) having a proximate end attached adjacent said first end edge (42) of said opening and having a free distal end extending outwardly from said first end edge;

(f) a second tongue having a proximate end attached adjacent said second end edge (44) of said opening and having a free distal end extending outwardly from said second edge, said first and second tongues normally overlapping and each being sized to completely close said opening;

(g) attachment means for detachably securing said distal end of (i) said first tongue to said side edges (16,23) of said opening to close completely said opening and cover and extend over said second tongue when said free distal end of said second tongue is inside said bag intermediate said first tongue and said bottom; and, (ii) said second tongue to said side edges (16,23) of said opening to close completely said opening and cover and extend over said first tongue when said free distal end of said first tongue is inside said bag intermediate said second tongue and said bottom;

said attachment means detachably securing to said side edges at any given time only one of said first and second tongues.

2. The bag of claim 1 wherein said attachment means comprises at least (a) one zipper track half attached to said first side edge (16) and interlockable with a zipper track half on said first tongue and a zipper track half on said second tongue, and (b) a second zipper track half attached to said second side edge (23) and interlockable with a zipper track half on said second tongue and with a zipper track half on said first tongue.

3. The bag of claim 1 wherein (a) said first tongue comprises a panel of water resistant material sized to cover said opening; and, (b) said second tongue comprises a panel of air permeable mesh material sized to cover said opening.

4. The bag of claim 3 wherein said air permeable mesh material is netting.

5. A bag including (a) a bottom;

(b) a top with an opening formed therethrough, said opening including first and second spaced apart opposing edges;

(c) a pair of opposed spaced apart ends extending downwardly from said top and upwardly from said bottom;

(d) a pair of opposed spaced apart sides each extending upwardly from said bottom, downwardly from said top, and laterally from said ends;

(e) a first tongue having a proximate end attached adjacent said first edge of said opening and having a free distal end extending outwardly from said first edge, said first tongue comprising a panel of water resistant material;

(f) a second tongue having a proximate end attached adjacent said second edge of said opening and having a free distal end extending outwardly from said second edge, said second tongue comprising a panel of air permeable mesh material, said first and second tongues each being sized to cover said opening;

(g) attachment means for detachably securing said distal end of (i) said first tongue to said bag to cover said opening and said second tongue when said free distal end of said second tongue is intermediate said first tongue and said bottom; and, (ii) said second tongue to said bag to cover said opening and said first tongue when said free distal end of said first tongue is intermediate said second tongue and said bottom.

6. The bag of claim 5 wherein said air permeable mesh material is netting.

* * * * *